US007336170B2

(12) United States Patent
Auerbach et al.

(10) Patent No.: US 7,336,170 B2
(45) Date of Patent: Feb. 26, 2008

(54) TAMPER-RESISTANT ELECTRONIC SEAL

(75) Inventors: Micha Auerbach, Maccabim (IL); Rony Cohen, Zoran (IL); Arcadi Genin, Bat Yam (IL); Ran Sender, Tel Aviv (IL)

(73) Assignee: Hi-G-Tek Inc. MD (US)

( * ) Notice: Subject to any disclaimer, the term of this patent is extended or adjusted under 35 U.S.C. 154(b) by 137 days.

(21) Appl. No.: 11/371,805

(22) Filed: Mar. 9, 2006

(65) Prior Publication Data

US 2006/0170560 A1 Aug. 3, 2006

Related U.S. Application Data

(63) Continuation of application No. 10/316,978, filed on Dec. 11, 2002, now Pat. No. 7,042,354.

(51) Int. Cl.
*G08B 1/08* (2006.01)

(52) U.S. Cl. ..... 340/539.31; 340/568.2; 340/572.8; 340/686.4

(58) Field of Classification Search ..... 340/539.27, 340/539.31, 568.1, 568.2, 572.1, 572.8, 686.4
See application file for complete search history.

(56) References Cited

U.S. PATENT DOCUMENTS 4,750,197 A 6/1988 Denekamp et al.
4,782,784 A 11/1988 Little
5,056,837 A 10/1991 Fuehrer
5,097,253 A 3/1992 Eschbach et al.
5,120,097 A 6/1992 Fattori et al.
5,127,687 A 7/1992 Guiler
5,166,929 A 11/1992 Lo
5,169,188 A 12/1992 Kupperman et al.
5,189,396 A 2/1993 Stobbe
5,392,025 A 2/1995 Figh et al.
5,396,227 A 3/1995 Carroll et al.
5,406,263 A 4/1995 Tuttle
5,410,301 A 4/1995 Dawson et al.
5,421,177 A 6/1995 Sieber et al.
5,471,212 A 11/1995 Sharpe et al.
5,525,992 A 6/1996 Froschermeier
5,534,847 A 7/1996 McGregor
5,565,858 A 10/1996 Guthrie
5,570,080 A 10/1996 Inoue et al.
5,574,977 A 11/1996 Joseph et al.
5,587,702 A 12/1996 Chadfield
5,594,738 A 1/1997 Crisler et al.
5,615,247 A * 3/1997 Mills ..... 455/411
5,615,249 A 3/1997 Solondz
5,630,209 A 5/1997 Wizgall et al.
5,642,355 A 6/1997 Smith
5,656,996 A 8/1997 Houser
5,691,980 A 11/1997 Welles, II et al.

(Continued)

*Primary Examiner*—Benjamin C. Lee
(74) *Attorney, Agent, or Firm*—Ladas & Parry

(57) ABSTRACT

A tamper-resistant remotely monitorable electronic seal including a shaft portion, a sensor, a socket arranged to engage the shaft portion and the sensor in a monitorable manner and a wireless communicator associated with at least one of the shaft portion, the sensor and the socket and being operative to provide a remotely monitorable indication of at least one monitorable event, the sensor being operative to sense application of force to the electronic seal in an attempt to separate the shaft portion from the socket and to indicate the application of force as one of the at least one monitorable event.

26 Claims, 6 Drawing Sheets

U.S. PATENT DOCUMENTS 5,831,531 A 11/1998 Tuttle
5,836,002 A 11/1998 Morstein et al.
5,910,944 A 6/1999 Callicotte et al.
5,912,623 A 6/1999 Pierson
5,940,006 A 8/1999 MacLellan et al.
6,023,218 A 2/2000 Tremblay
6,055,426 A 4/2000 Beasley
6,069,563 A 5/2000 Kadner et al.
6,078,258 A 6/2000 Auerbach et al.
6,154,139 A 11/2000 Heller
6,166,627 A * 12/2000 Reeley ..... 340/426.25
6,216,003 B1 4/2001 Hamajima et al.
6,243,005 B1 6/2001 Haimovich et al.
6,256,493 B1 7/2001 Dorenbosch et al.
6,262,664 B1 7/2001 Maloney
6,265,973 B1 7/2001 Brammall et al.
6,288,629 B1 9/2001 Cofino et al.
6,300,903 B1 10/2001 Richards et al.
6,339,397 B1 * 1/2002 Baker ..... 342/357.07
6,366,779 B1 4/2002 Bender et al.
6,369,710 B1 4/2002 Poticny et al.
6,420,971 B1 7/2002 Leck et al.
6,421,540 B1 7/2002 Gilhousen et al.
6,466,558 B1 10/2002 Ling
6,507,567 B1 1/2003 Willars
6,590,886 B1 7/2003 Easton et al.
6,593,845 B1 7/2003 Friedman et al.
6,646,555 B1 11/2003 Forester et al.
6,744,366 B2 6/2004 How
6,753,775 B2 * 6/2004 Auerbach et al. ..... 340/539.22
6,774,807 B1 8/2004 Lehfeldt et al.
6,870,485 B2 * 3/2005 Lujan et al. ..... 340/870.16

* cited by examiner

TAMPER-RESISTANT ELECTRONIC SEAL

This application is a continuation of application number 10/316,978 filed on Dec. 11, 2002 now U.S. Pat. No. 7,042,354 claims the benefit thereof and incorporates the same by reference.

FIELD OF THE INVENTION

The present invention relates to electronic seals generally and more particularly to tamper-resistant electronic seals.

BACKGROUND OF THE INVENTION

The following U.S. patents are believed to be representative of the prior art:

U.S. Pat. Nos. 4,750,197; 5,056,837; 5,097,253; 5,127,687; 5,169,188; 5,189,396; 5,406,263; 5,421,177; 5,587,702; 5,656,996 and 6,069,563.

SUMMARY OF THE INVENTION

The present invention seeks to provide an improved electronic seal.

There is thus provided in accordance with a preferred embodiment of the present invention a tamper-resistant remotely monitorable electronic seal including a shaft portion, a sensor, a socket arranged to engage the shaft portion and the sensor in a monitorable manner and a wireless communicator associated with at least one of the shaft portion, the sensor and the socket and being operative to provide a remotely monitorable indication of at least one monitorable event, the sensor being operative to sense application of force to the electronic seal in an attempt to separate the shaft portion from the socket and to indicate the application of force as one of the at least one monitorable event.

Preferably, the sensor is also operative to sense disengagement of the shaft portion and the sensor and to indicate the disengagement as one of the at least one monitorable event.

In accordance with another preferred embodiment of the present invention, the tamper-resistant remotely monitorable electronic seal also includes a sensing cap mounted on the shaft portion and supporting the sensor. Additionally or alternatively, the sensor includes a temperature sensor which is operative to monitor heating of the socket and to indicate heating thereof beyond a predetermined threshold as one of the at least one monitorable event.

In accordance with another preferred embodiment of the present invention, the tamper-resistant remotely monitorable electronic seal also includes at least one retaining ring engaging the socket and the shaft portion for retaining the sensing cap in the socket independently of the shaft portion and wherein the shaft portion includes a frangible portion, whereby application of a force to separate the shaft portion from the socket causes breakage between the sensing cap and the shaft portion at the frangible portion, which breakage is one of the at least one monitorable event.

In accordance with still another preferred embodiment of the present invention, the socket includes a single-use socket. Alternatively, the socket is a mechanically lockable socket.

In accordance with another preferred embodiment of the present invention, the socket includes a transponder and the shaft portion includes an inductor, the transponder being operative to transmit information relating to the socket, via the inductor, to the wireless communicator. Preferably, the transponder includes an RF transponder and the inductor includes an RF receive/transmit inductor and wherein the inductor communicates via at least one conductor extending through the shaft portion to the wireless communicator.

In accordance with yet another preferred embodiment of the present invention, the shaft portion includes at least one conductor which is interrupted in response to disengagement of the shaft portion and the sensor and wherein the disengagement results in one of the at least one monitorable event.

Preferably, the communicator is located in a sensing circuitry and communicator housing integrally formed with the shaft portion.

In accordance with still another preferred embodiment of the present invention, there is associated with the at least one conductor at least one propinquity switch which is operated by an actuator associated with the socket whereby when the shaft portion is separated from the socket the switch is opened and the at least one conductive path is broken, producing one of the at least one monitorable event. Preferably, the at least one propinquity switch includes at least one magnetic switch and the actuator includes a magnet.

Further in accordance with another preferred embodiment of the present invention, the shaft portion includes a frangible shaft portion having a lockable portion and the socket includes a locking element arranged to engage the lockable portion in a removable manner, whereby disengagement of the locking element and the shaft portion results in one of the at least one monitorable event.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
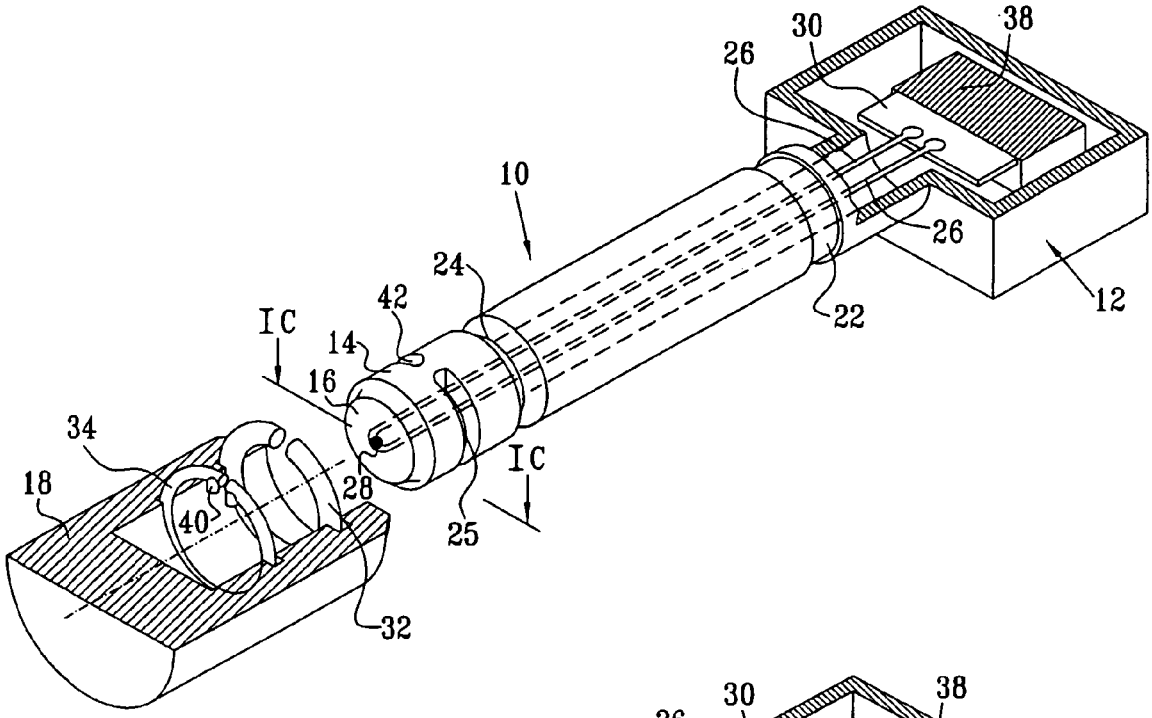
FIGS. 1A and 1B are simplified pictorial illustrations of a press-fit electronic seal assembly constructed and operative in accordance with a preferred embodiment of the present invention.
Figure 1B:
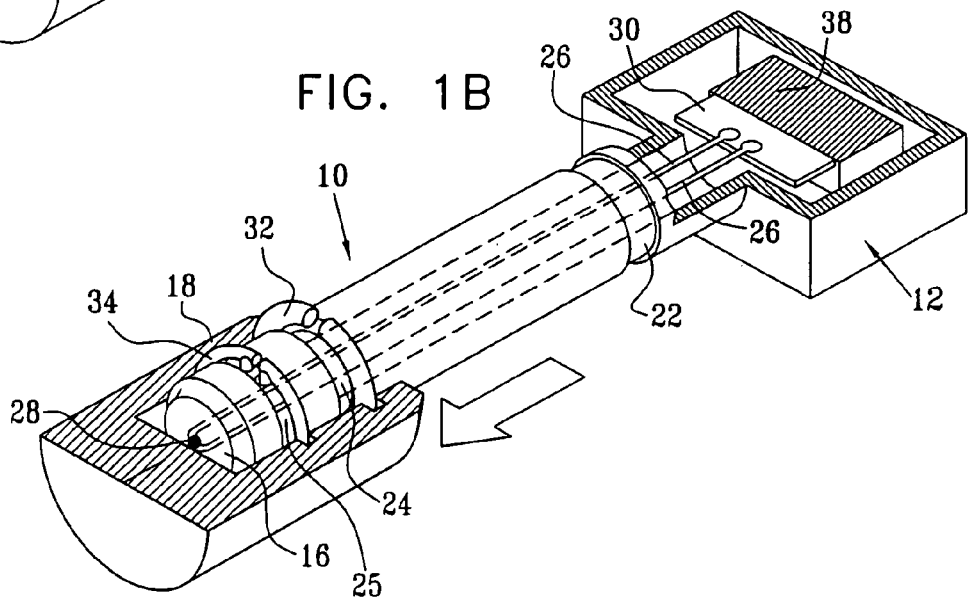
Figure 1C:
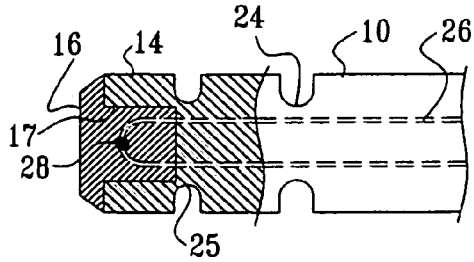
FIG. 1C is a sectional illustration of a portion of the press-fit electronic seal of FIGS. 1A and 1B.

Reference is now made to FIGS. 1A, 1B and 1C, which are, respectively, simplified pictorial illustrations and a sectional illustration of a press-fit electronic seal constructed and operative in accordance with a preferred embodiment of the present invention.

As seen in FIGS. 1A, 1B and 1C, there is provided a tamper-resistant electronic seal which preferably comprises a shaft portion 10, which is integrally formed with or fixed to a sensing circuitry and transceiver portion 12. Shaft portion 10 preferably has a generally cylindrical configuration and terminates in a press-fit tip 14, which includes a sensing cap 16 fixed within a recess 17 formed at a forward end thereof and which adapted for press-fit engagement with a socket 18. The press-fit engagement between tip 14 of shaft portion 10 and socket 18 is preferably constructed such that it is impossible to remove the press-fit tip 14 from the socket 18 without breaking the shaft portion 10. The press-fit engagement between press-fit tip 14 and socket 18 is such that the application of a low-level force to the socket 18 or the shaft portion 10 causes part of the press-fit tip 14 including the sensing cap 16 to separate from the shaft portion 10, as described hereinbelow with reference to FIG. 2A.

Shaft portion 10 preferably includes weakened frangible portions 22, 24 and 25. Frangible portions 22, 24 and 25 typically have a lesser thickness than the remainder of the shaft portion 10. Frangible portion 22 is preferably located intermediate sensing circuitry and transceiver portion 12 and most of shaft portion 10. Frangible portions 24 and 25 are preferably located in shaft portion 10 at a location adjacent tip 14. Typical locations of frangible portions 22, 24 and 25 are illustrated in FIGS. 1A and 1B.

At least one conductive loop 26 preferably extends from sensing circuitry and transceiver portion 12 through shaft portion 10, preferably extending into recess 17, and is configured and mounted in shaft portion 10, such that breakage of the shaft portion 10 produces a disconnection or significant change in the properties, such as the electromagnetic, mechanical and/or thermal properties, of the conductive loop 26. In accordance with a preferred embodiment of the present invention, sensing cap 16 is attached to press-fit tip 14 such that it is in contact, preferably electrical contact, with conductive loop 26. Sensing cap 16 preferably includes at least one sensor 28, such as a temperature sensor or any other suitable sensor. Sensor 28 is preferably connected to conductive loop 26, such as by crimping. Conductive loop 26 is operative to transmit information from the sensor 28 to sensing circuitry 30, forming part of sensing circuitry and transceiver portion 12.

It is appreciated that, even though in the illustrated embodiment sensor 28 is located on sensing cap 16, one or more sensors 28 may alternatively be located at any suitable location in communication with conductive loop 26.

Socket 18 also preferably comprises a sealing ring 32, which preferably engages a recess defining frangible portion 24, and a sealing ring 34, which preferably engages a recess defining frangible portion 25. Sealing rings 32 and 34 preferably provide press-fit engagement between press-fit tip 14 and socket 18.

In accordance with a preferred embodiment of the present invention, a transceiver, preferably an RF transceiver 38, also forms part of sensing circuitry and transceiver portion 12. Sensing circuitry 30 preferably is electrically coupled to conductive loop 26 and senses the integrity thereof. In another preferred embodiment, sensing circuitry 30 is also operative to receive indications from sensor 28, such as changes in temperature, which might be caused, for example, by someone attempting to tamper with the electronic seal by heating the socket 18. Alternatively, sensing circuitry 30 may be operative to receive indications of engagement or disengagement of shaft portion 10 with respect to sealing rings 32 and 34 or socket 18.

Transceiver 38 receives an output from sensing circuitry 30, which is operative to provide transmitted information indicating whether the conductive loop 26 is intact as well as other information received from sensor 28 via conductive loop 26. Conventional wireless monitoring circuitry (not shown) may be employed to receive information which is transmitted by RF transceiver 38 indicating tampering with the seal, which results in breakage of the conductive loop 26 and/or any other information received from sensor 28, such as heating of the socket 18 or engagement or disengagement of the shaft portion 10.

In accordance with another preferred embodiment, sealing ring 34 includes at least one engagement protrusion 40 and frangible portion 25 includes at least one corresponding engagement recess 42. In this embodiment, frangible portion 25 is locked by sealing ring 34, such that a low level force causes the disconnection of the sensing cap 16 and the part of tip 14 adjacent thereto from the shaft portion 10, as described hereinbelow with reference to FIG. 2A. Alternatively, at least one engagement protrusion (not shown) may be located in socket 18 which engages at least one engagement slot (not shown) located in sensing cap 16. The insertion of engagement protrusion 40 into engagement recess 42 preferably locks the sensing cap 16 into the socket 18, such that a low level force causes the disconnection of the sensing cap 16 from shaft portion 10, as described hereinbelow with reference to FIG. 2A. Engagement protrusion 40 may be flexible to provide enhanced ease of engagement with engagement location 42. Alternatively, engagement protrusion 40 and corresponding engagement recess 42 may be obviated.

Figure 2A:
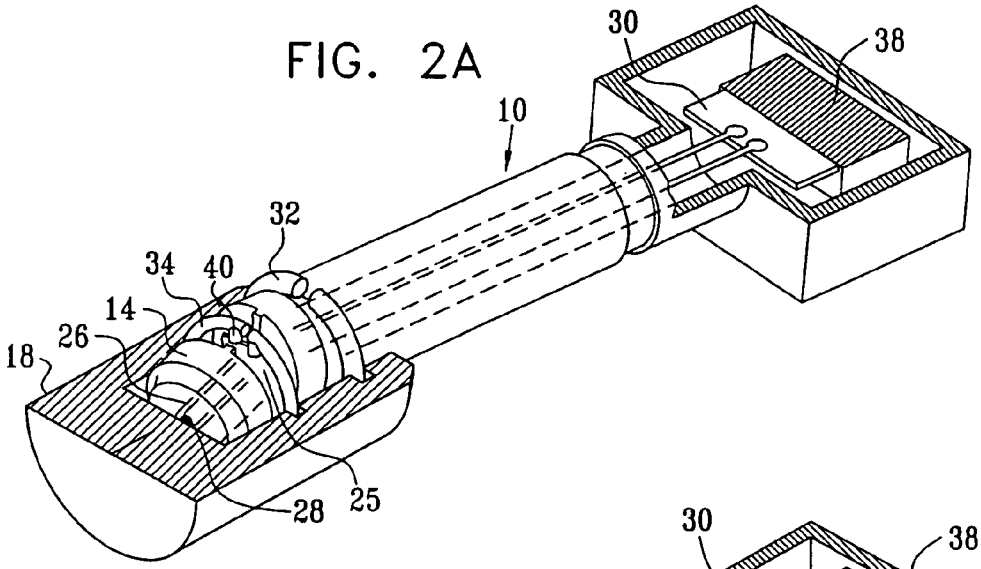
FIGS. 2A, 2B and 2C are simplified pictorial illustrations of different types of breaks produced in the press-fit electronic seal of FIGS. 1A-1C.
Figure 2B:
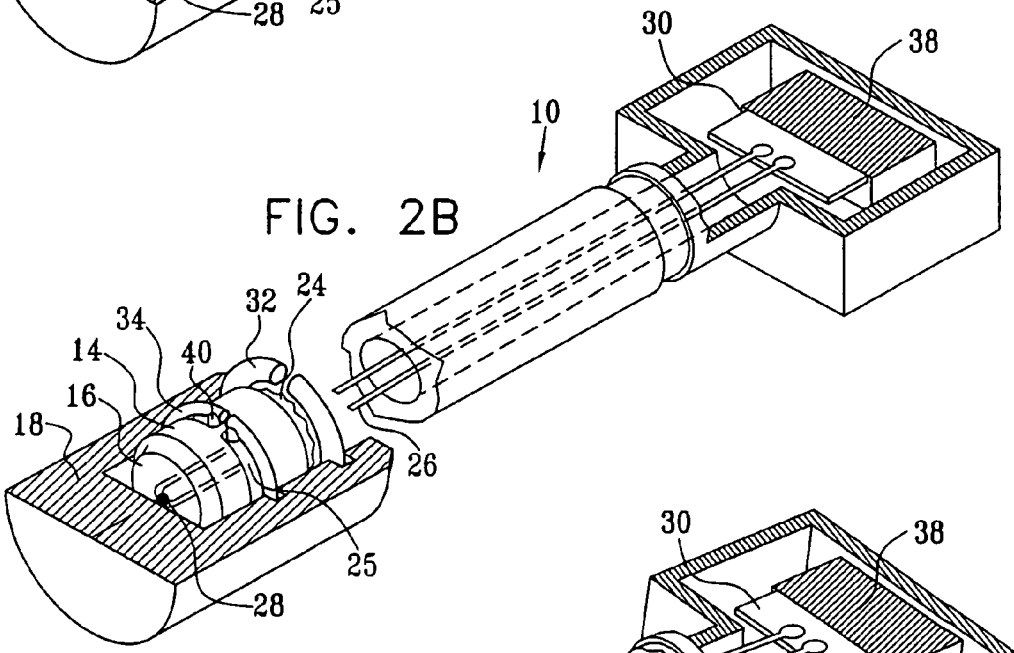
Figure 2C:
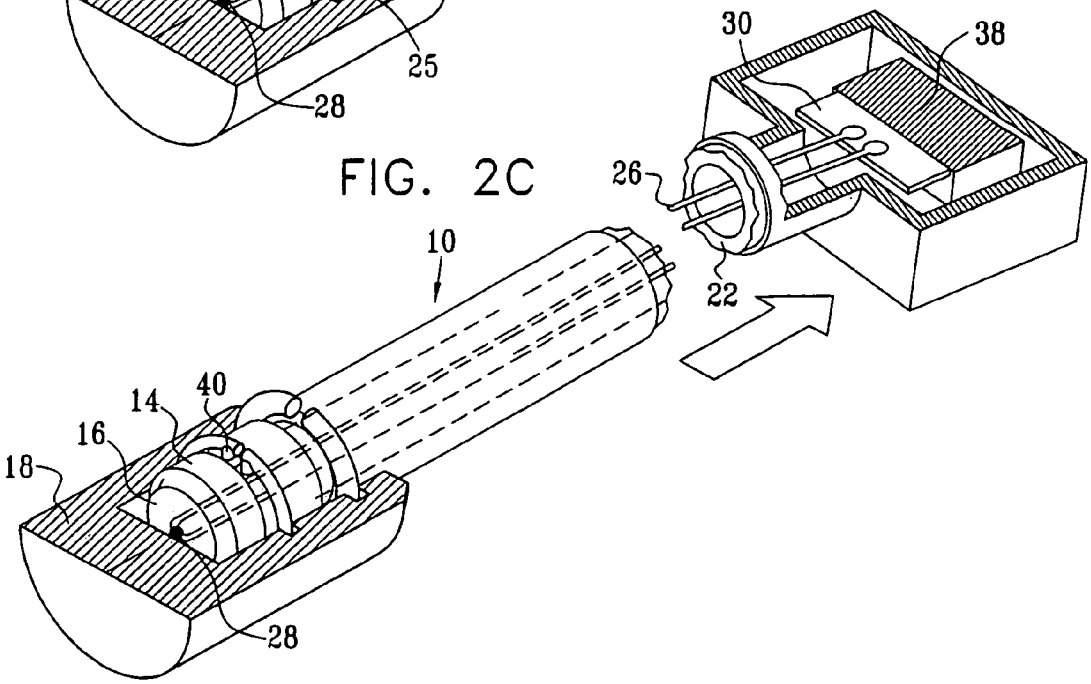

Reference is now made to FIGS. 2A, 2B and 2C, which are simplified pictorial illustrations of various different types of breaks produced in the press-fit electronic seal of FIGS. 1A-1C by tampering therewith. As noted above, application of force to the seal of FIGS. 1A-1C in an attempt to separate shaft portion 10 from socket 18 will not cause tip 14 to be disengaged from socket 18, without first breaking the shaft portion 10. FIG. 2A shows that applying a low level force, such as a rotational and/or lateral force in an attempt to open the seal, results in a break at frangible portion 25, causing a significant change in or disconnection of conductive loop 26. Preferably, the sensing circuitry 30 senses the change in conductive loop 26, even though the seal remains intact as shaft portion 10 is engaged by sealing ring 32.

FIG. 2B shows the results of applying a higher level force, such as might be produced by attempting to remove socket 18 from shaft portion 10, resulting in a break at frangible portion 24, producing a disconnection in conductive loop 26.

FIG. 2C illustrates a break, which might be produced in a similar manner as that shown in FIG. 2B, at the frangible portion 22. It is seen that this break also typically produces a disconnection in conductive loop 26.

It is appreciated that the breaks shown in FIGS. 2B and 2C, while illustrated independently of the break produced in FIG. 2A, may be preceded by the break in FIG. 2A when an attempt is made to tamper with the electronic seal.

Figure 2D:
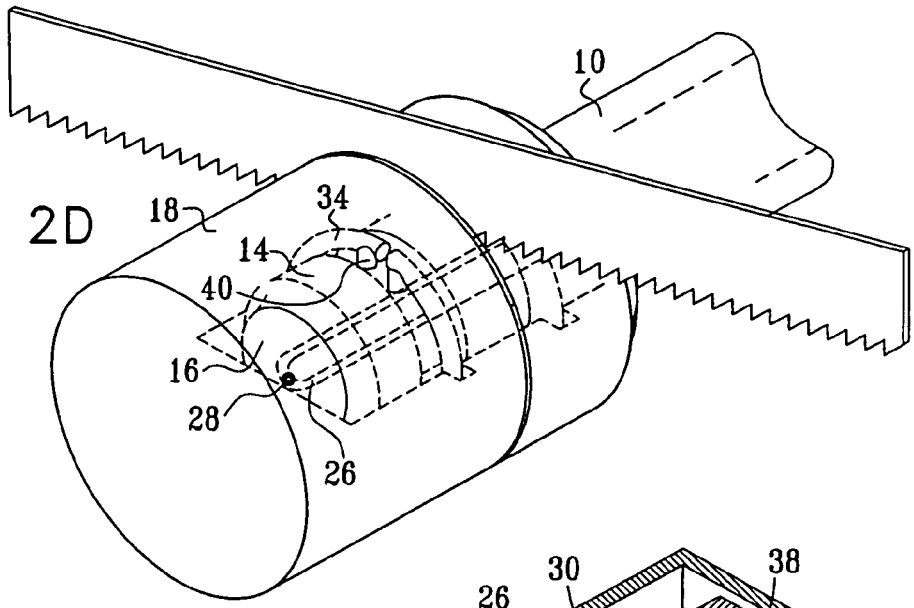
FIGS. 2D, 2E and 2F are simplified pictorial illustrations showing the result of another attempt to tamper with the press-fit electronic seal of FIGS. 1A-1C.
Figure 2E:
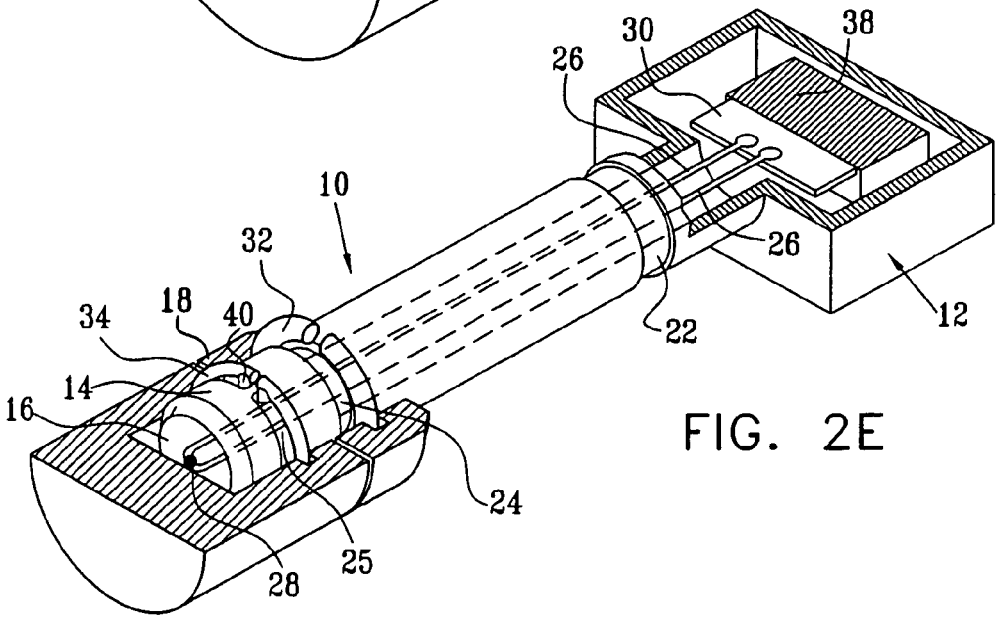
Figure 2F:
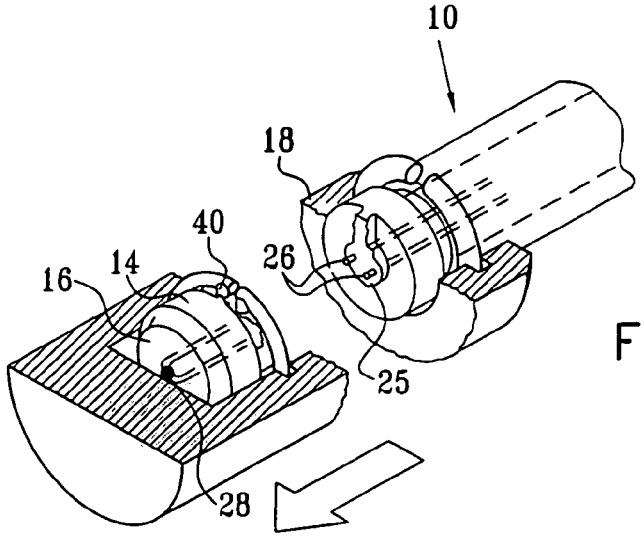

Reference is now made to FIGS. 2D, 2E and 2F which are simplified pictorial illustrations of another attempt to tamper with the press-fit electronic seal of FIGS. 1A-1C. As seen in FIG. 2D, an attempt is made to separate socket 18 from shaft portion 10 of the tamper-resistant electronic seal by sawing through socket 18 in the region of tip 14 of shaft portion 10. FIG. 2E shows the resulting cut in socket 18, where shaft portion 10 has not been cut. FIG. 2F shows that the resulting separation of the socket 18 causes a break along frangible portion 25, resulting in a disconnection of conductive loop 26.

It is appreciated that any significant change in the properties, such as the electromagnetic, mechanical and/or thermal properties, or disconnection of conductive loop 26 is sensed by sensing circuitry 30 and transmitted by RF transceiver 38.

Figure 3A:
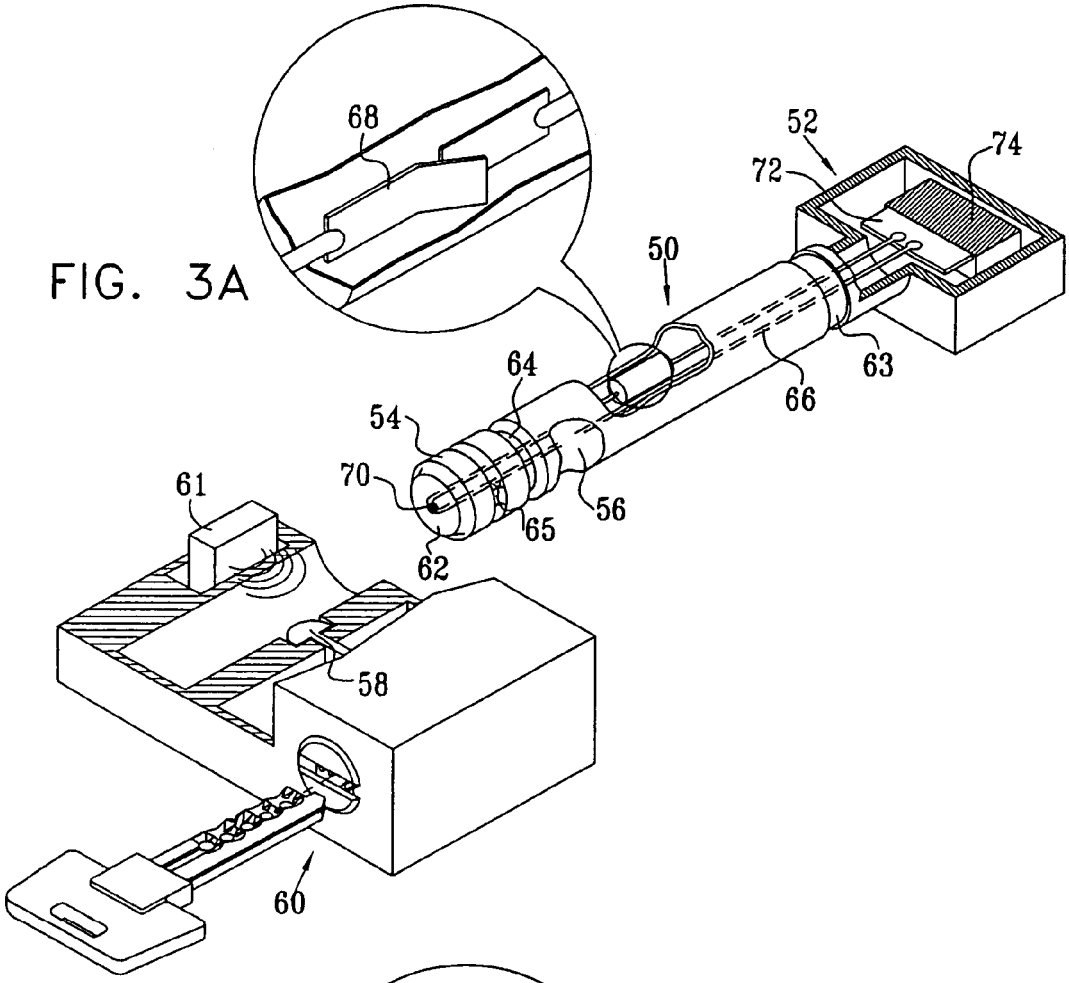
FIGS. 3A and 3B are simplified pictorial illustrations of a lockable electronic seal constructed and operative in accordance with a preferred embodiment of the present invention in respective unlocked and locked operative orientations.
Figure 3B:
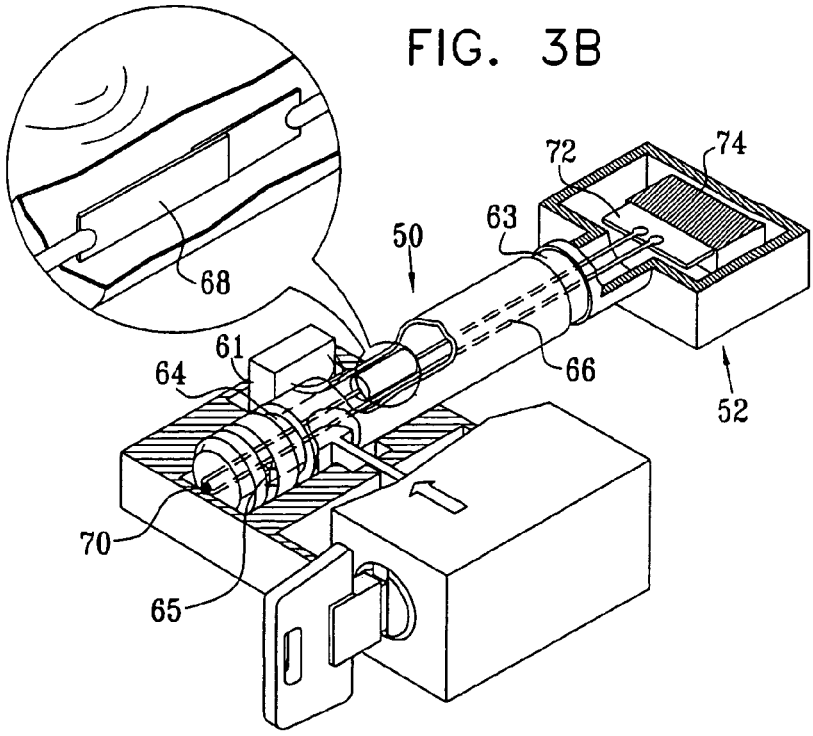

Reference is now made to FIGS. 3A and 3B, which are simplified pictorial illustrations of a lockable electronic seal constructed and operative in accordance with a preferred embodiment of the present invention in respective unlocked and locked operative orientations.

As seen in FIGS. 3A and 3B, there is provided a tamper-resistant reusable lockable electronic seal which preferably comprises a shaft portion 50, which is integrally formed with or fixed to a sensing circuitry and transceiver portion 52. Shaft portion 50 preferably has a generally cylindrical configuration and terminates in a lockable tip 54, preferably formed with an undercut groove 56 which is adapted for lockable engagement therewith by a corresponding locking element 58 forming part of a lock 60. Lock 60 defines a socket, which includes an actuator such as a magnet 61. Lock 60 is here shown to be a key-operated lock, it being appreciated that any other suitable type of lock may be employed. The locking engagement between tip 54 of shaft portion 50 and locking element 58 is preferably such that without first unlocking the lock, it is impossible to remove the tip 54 from engagement with the locking element 58 without breaking the shaft portion 50. Lockable tip 54 is preferably attached to or integrally formed with a sensing cap 62.

Shaft portion 50 preferably includes weakened frangible portions 63, 64 and 65, preferably having a lesser thickness than the remainder of the shaft portion 50. Frangible portion 63 is preferably located intermediate sensing circuitry and transceiver portion 52 and most of shaft portion 50. Frangible portions 64 and 65 are preferably located in shaft portion 50 at a location adjacent tip 54. Typical locations of frangible portions 63, 64 and 65 are illustrated in FIGS. 3A and 3B.

At least one conductive loop 66 preferably extends through shaft portion 50 and is configured and mounted in shaft portion 50, such that breakage of the shaft portion 50 produces a disconnection or significant change in the properties, such as the electromagnetic, mechanical and/or thermal properties, of the conductive loop 66. Preferably connected in series with conductive loop 66 there is provided a propinquity switch which is operated when the actuator in the socket is separated therefrom by at least a threshold distance. Preferably, the propinquity switch is a magnetically operated switch 68, which is closed only when in propinquity to magnet 61, such as when shaft portion 50 is in lockable or locked engagement with lock 60.

It is appreciated that shaft portion 50 may comprise one or more additional conductive loops, each of which may include a switch, the operation of which may or may not be linked to the operation of lock 60 and may provide additional information regarding the integrity of the electronic seal.

Additionally, in accordance with a preferred embodiment of the present invention, sensing cap 62 is in electrical contact with conductive loop 66. Sensing cap 62 preferably includes at least one sensor 70, such as a temperature sensor or other suitable sensor, and communicates via conductive loop 66 with sensing circuitry 72.

It is appreciated that, even though in the illustrated embodiment sensor 70 is located adjacent lockable tip 54, one or more sensors 70 may alternatively be located at any suitable location in communication with conductive loop 66.

In accordance with a preferred embodiment of the present invention, sensing circuitry 72 and an RF transceiver 74 are housed within sensing circuitry and transceiver portion 52. Sensing circuitry 72 is electrically coupled to conductive loop 66 and senses the integrity thereof. Additionally, sensing circuitry 72 is also operative to receive indications from sensor 70, such as a change in temperature, which might be caused, for example, by someone attempting to tamper with the electronic seal by heating the lock 60. Transceiver 74 preferably receives an output from sensing circuitry 72, which is operative to provide transmitted information indicating whether the conductive loop 66 is intact as well as information received from sensor 70 via conductive loop 66.

Conventional wireless monitoring circuitry (not shown) may be employed to receive information which is transmitted by RF transceiver 74 and indicates when the shaft portion 50 is located in lockable or locked engagement with lock 60 and when the shaft portion 50 is separated from lock 60 due to either tampering with the seal, which may or may not result in breakage of the shaft portion 50, or mutual disengagement of shaft portion 50 and lock 60 by using a key to unlock lock 60.

It is appreciated that the provision of the switch 68 enables sensing circuitry 72 to sense when the shaft portion 50 is located in lockable engagement with lock 60 and when the shaft portion 50 is separated from lock 60 for any reason, and allows for recording of engagements and disengagements of shaft portion 50 and lock 60.

It is appreciated that the switch shown in the illustrated embodiments of FIGS. 3A-3B can also be employed in the embodiments of FIGS. 1A-2F.

Figure 4A:
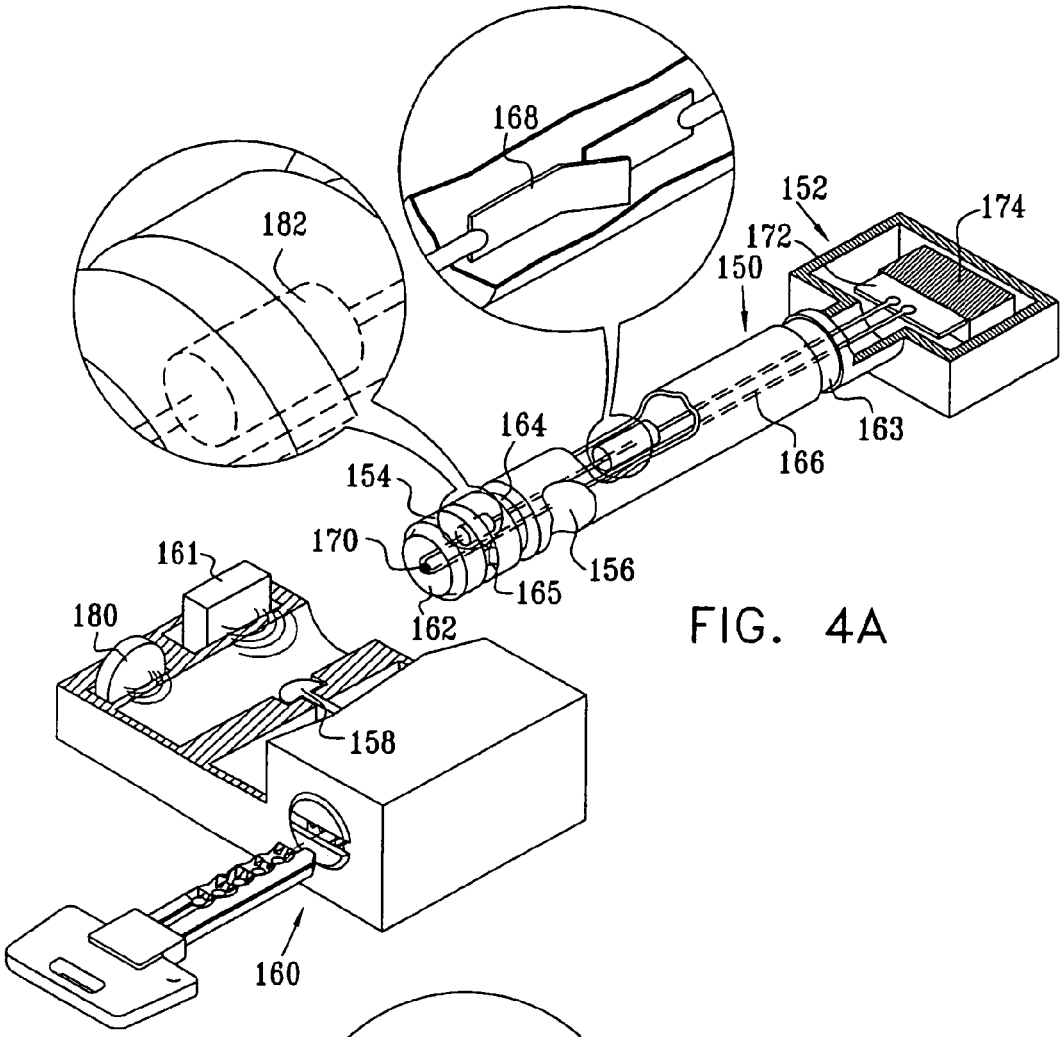
FIGS. 4A and 4B are simplified pictorial illustrations of a lockable electronic seal constructed and operative in accordance with another preferred embodiment of the present invention in respective unlocked and locked operative orientations.
Figure 4B:
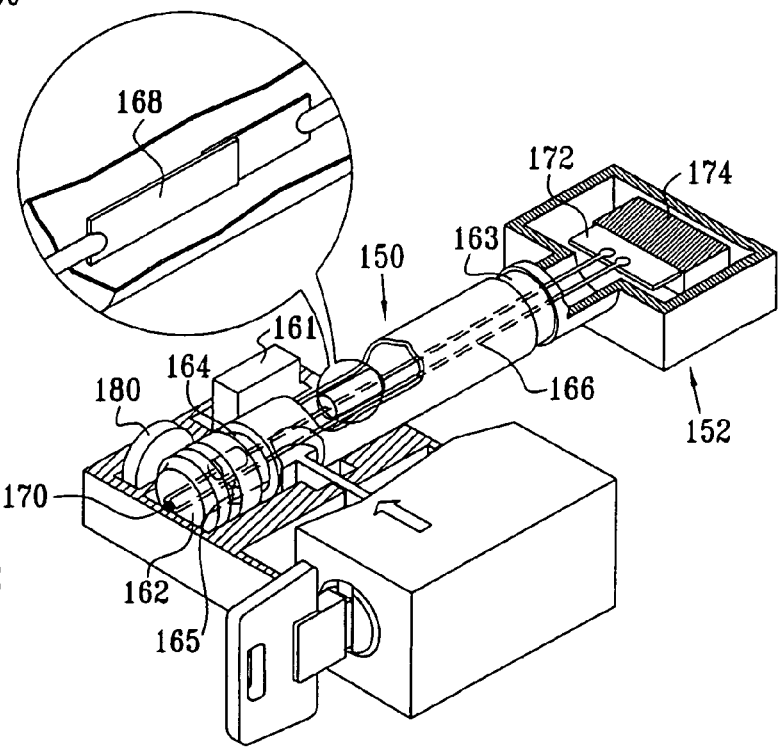

Reference is now made to FIGS. 4A and 4B, which are simplified pictorial illustrations of a lockable electronic seal constructed and operative in accordance with a preferred embodiment of the present invention in respective unlocked and locked operative orientations.

As seen in FIGS. 4A and 4B, there is provided a tamper-resistant reusable lockable electronic seal which preferably comprises a shaft portion 150, which is integrally formed with or fixed to a sensing circuitry and transceiver portion 152. Shaft portion 150 preferably has a generally cylindrical configuration and terminates in a lockable tip 154, preferably formed with an undercut groove 156 which is adapted for lockable engagement therewith by a corresponding locking element 158 forming part of a lock 160. Lock 160 defines a socket, which preferably includes an actuator such as a magnet 161. Lock 160 is here shown to be a key-operated lock, it being appreciated that any other suitable type of lock may be employed. The locking engagement between tip 154 of shaft portion 150 and locking element 158 is preferably such that without first unlocking the lock, it is impossible to remove the tip 154 from engagement with the locking element 158 without breaking the shaft portion 150. Lockable tip 154 is preferably attached to or integrally formed with a sensing cap 162.

Shaft portion 150 preferably includes weakened frangible portions 163, 164 and 165, preferably having a lesser thickness than the remainder of the shaft portion 150. Frangible portion 163 is preferably located intermediate sensing circuitry and transceiver portion 152 and most of shaft portion 150. Frangible portions 164 and 165 are preferably located in shaft portion 150 at a location adjacent tip 154. Typical locations of frangible portions 163, 164 and 165 are illustrated in FIGS. 4A and 4B.

At least one conductive loop 166 preferably extends through shaft portion 150 and is configured and mounted in shaft portion 150, such that breakage of the shaft portion 150 produces a disconnection or significant change in the properties, such as the electromagnetic, mechanical and/or thermal properties, of the conductive loop 166. Preferably connected in series with conductive loop 166 there is provided a propinquity switch which is operated when the actuator in the socket is separated therefrom by at least a threshold distance. Preferably, the propinquity switch is a magnetically operated switch 168, which is closed only when in propinquity to magnet 161, such as when shaft portion 150 is in lockable or locked engagement with lock 160.

It is appreciated that shaft portion 150 may comprise one or more additional conductive loops, each of which may include a switch, the operation of which may or may not be linked to the operation of lock 160 and may provide additional information regarding the integrity of the electronic seal.

Additionally, in accordance with a preferred embodiment of the present invention, sensing cap 162 is in electrical contact with conductive loop 166. Sensing cap 162 preferably includes at least one sensor 170, such as a temperature sensor or other suitable sensor, and communicates via conductive loop 166 with sensing circuitry 172.

It is appreciated that, even though in the illustrated embodiment sensor 170 is located adjacent lockable tip 154, one or more sensors 170 may alternatively be located at any suitable location in communication with conductive loop 166.

In accordance with a preferred embodiment of the present invention, sensing circuitry 172 and an RF transceiver 174 are housed within sensing circuitry and transceiver portion 152. Sensing circuitry 172 is electrically coupled to conductive loop 166 and senses the integrity thereof. In another preferred embodiment, sensing circuitry 172 is also operative to receive indications from sensor 170, such as a change in temperature, which might be caused, for example, by someone attempting to tamper with the electronic seal by heating the lock 160. Transceiver 174 preferably receives an output from sensing circuitry 172, which is operative to provide transmitted information indicating whether the conductive loop 166 is intact as well as information received from sensor 170 via conductive loop 166.

Conventional wireless monitoring circuitry (not shown) may be employed to receive information which is transmitted by RF transceiver 174 and indicates when the shaft portion 150 is located in lockable or locked engagement with lock 160 and when the shaft portion 150 is separated from lock 160 due to either tampering with the seal, which may or may not result in breakage of the shaft portion 150, or mutual disengagement of shaft portion 150 and lock 160 by using a key to unlock lock 160.

As seen in FIGS. 4A and 4B, the tamper-resistant reusable lockable electronic seal also preferably includes a transponder 180, such as an RF transponder chip, and shaft portion 150 preferably includes an inductor 182, such as an RF receive/transmit inductor. Transponder 180 is operative to transmit information relating to the lock 160, via the inductor 182 located in shaft portion 150, to the sensing circuitry 172.

It is appreciated that the provision of the transponder 180 and the inductor 182 enables sensing circuitry 172 to record information transmitted by transponder 180 relating to the lock 160, such as, for example, a serial number of the lock 160, and the fact that shaft portion 150 is in locking engagement therewith. It is further appreciated that the provision of the transponder 180 and the inductor 182 enables sensing circuitry 172 to sense when the shaft portion 150 is located in lockable or locked engagement with lock 160 or when the shaft portion 150 is separated from lock 160 for any reason, and allows for recording of engagements and disengagements of shaft portion 150 and lock 160.

Additionally, it is appreciated that the provision of the switch 168 enables sensing circuitry 172 to sense when the shaft portion 150 is located in lockable engagement with lock 160 and when the shaft portion 150 is separated from lock 160 for any reason, and allows for recording of engagements and disengagements of shaft portion 150 and lock 160.

Figure 5A:
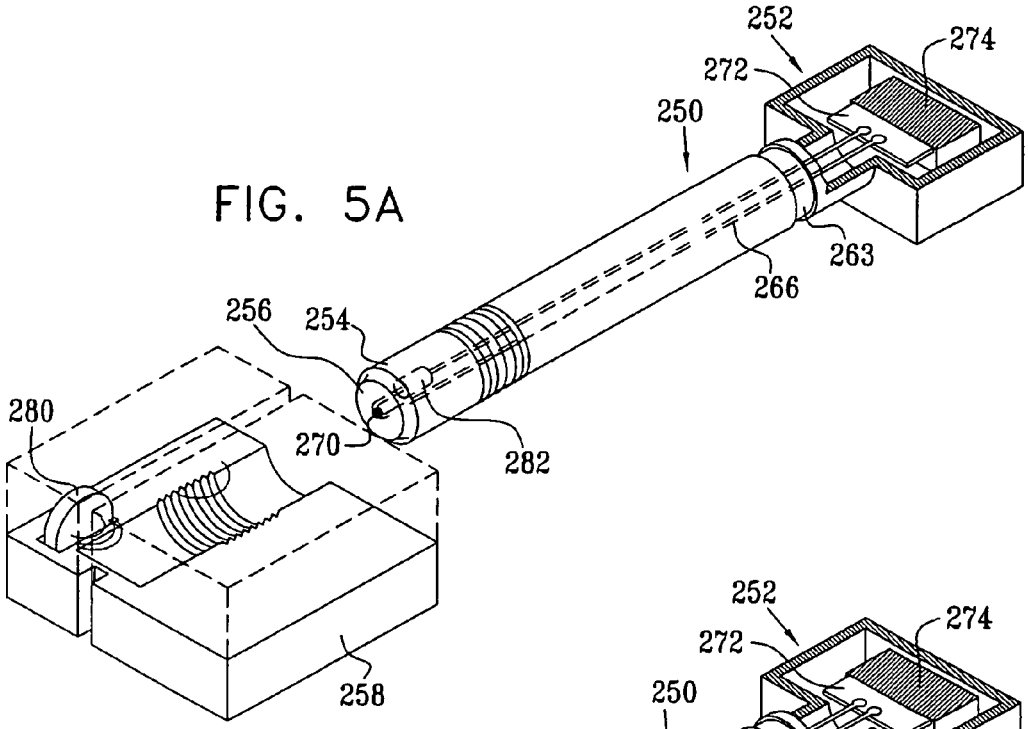
FIGS. 5A, 5B and 5C are simplified pictorial illustrations of a lockable electronic seal constructed and operative in accordance with yet another preferred embodiment of the present invention in three operative orientations.
Figure 5B:
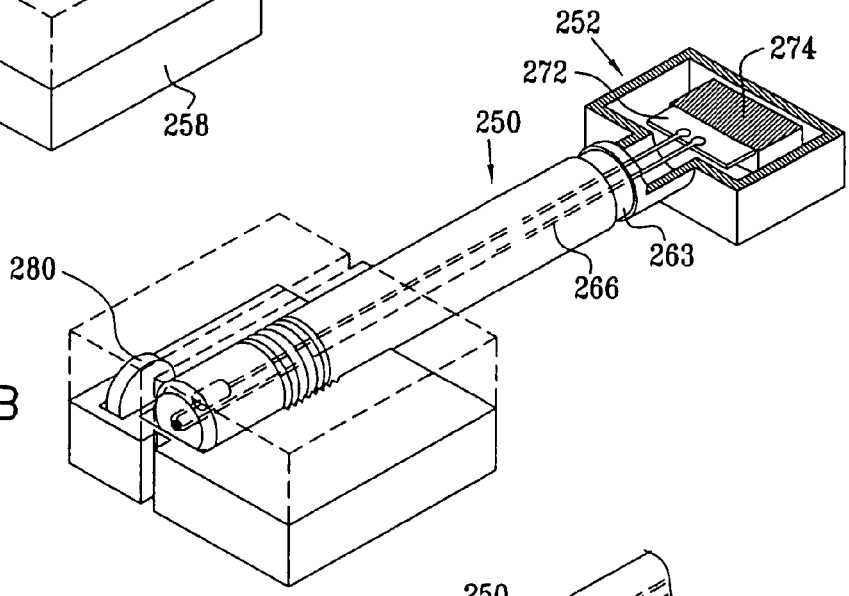
Figure 5C:
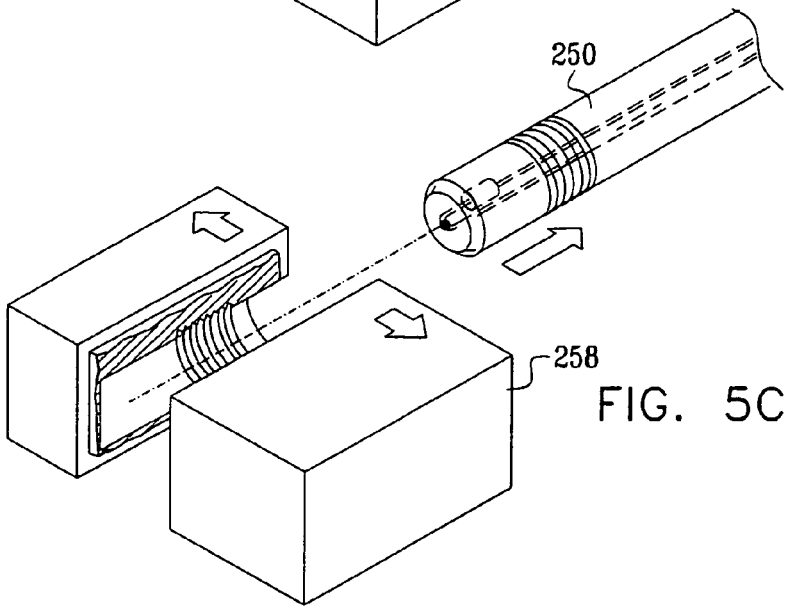

Reference is now made to FIGS. 5A, 5B and 5C, which are simplified pictorial illustrations of a press-fit electronic seal constructed and operative in accordance with yet another preferred embodiment of the present invention.

As seen in FIGS. 5A and 5B, there is provided a tamper-resistant reusable electronic seal which preferably comprises a reusable shaft portion 250, which is integrally formed with or fixed to a sensing circuitry and transceiver portion 252. Shaft portion 250 preferably has a generally cylindrical configuration and terminates in a press-fit tip 254, which includes a sensing cap 256 fixed within a recess (not shown) formed at a forward end thereof and adapted for press-fit engagement with a single-use locking socket 258. The press-fit engagement between tip 254 of shaft portion 250 and single-use locking socket 258 is preferably constructed such that it is impossible to remove the tip 254 from the single-use locking socket 258 without breaking either the shaft portion 250 or the single-use locking socket 258. The press-fit engagement between press-fit tip 254 and single-use locking socket 258 is such that the application of a low-level force to the single-use locking socket 258 or the shaft portion 250 causes part of the press-fit tip 254 including the sensing cap 256 to separate from the shaft portion 250, similar to that described hereinabove with reference to FIG. 2A.

Shaft portion 250 preferably includes a weakened frangible portion 263, located intermediate the sensing circuitry and transceiver portion 252 and the tip 254. Frangible portion 263 typically has a lesser thickness than the remainder of the shaft portion 250. Additional frangible portions (not shown) may also be included at suitable locations along shaft portion 250.

At least one conductive loop 266 preferably extends from sensing circuitry and transceiver portion 252 through shaft portion 250 and tip 254 and is configured and mounted in shaft portion 250, such that breakage of the shaft portion 250 produces a disconnection or significant change in the properties, such as the electromagnetic, mechanical and/or thermal properties, of the conductive loop 266. In accordance with a preferred embodiment of the present invention, sensing cap 256 is attached to tip 254 such that it is in electrical contact with conductive loop 266. Sensing cap 256 preferably includes at least one sensor 270, such as a temperature sensor or any other suitable sensor. Sensor 270 is preferably electrically connected to conductive loop 266 and is operative to transmit information via conductive loop 266 to sensing circuitry 272.

It is appreciated that, even though in the illustrated embodiment sensor 270 is located adjacent sensing cap 256, one or more sensors 270 may alternatively be located at any suitable location in communication with conductive loop 266.

In accordance with a preferred embodiment of the present invention, sensing circuitry 272 and a transceiver, such as an RF transceiver 274, are housed within sensing circuitry and transceiver portion 252. Sensing circuitry 272 preferably is electrically coupled to conductive loop 266 and senses the integrity thereof. Additionally, sensing circuitry 272 is preferably also operative to receive indications from sensor 270, such as changes in temperature, which might be caused, for example, by someone attempting to tamper with the electronic seal by heating the single-use locking socket 258. Alternatively, sensing circuitry 272 may be operative to receive indications of engagement or disengagement of shaft portion 250 from single-use locking socket 258, as described hereinbelow.

Transceiver 274 receives an output from sensing circuitry 272, which is operative to provide information indicating whether the conductive loop 266 is intact as well as information received from sensor 270 via conductive loop 266. Conventional wireless monitoring circuitry (not shown) may be employed to receive information which is transmitted by RF transceiver 274 indicating tampering with the seal, which results in breakage of the conductive loop 266 and/or any other information received from sensor 270, such as heating or removal of the single-use locking socket 258.

As seen in FIGS. 5A and 5B, the single-use locking socket 258 preferably includes a transponder 280, such as an RF transponder chip, and shaft portion 250 preferably includes an inductor 282, such as an RF receive/transmit inductor. Transponder 280 is operative to transmit information relating to the single-use locking socket 258, via the inductor 282 located in shaft portion 250, to the sensing circuitry 272. It is appreciated that the provision of the transponder 280 and the inductor 282 enables sensing circuitry 272 to record information about the single-use locking socket 258, such as, for example, a serial number of the single-use locking socket 258 and the fact that shaft portion 250 is in locking engagement therewith. It is further appreciated that the provision of the transponder 280 and the inductor 282 enables sensing circuitry 272 to sense when the shaft portion 250 is in engagement with single-use locking socket 258 and when the shaft portion 250 is separated from single-use locking socket 258.

FIG. 5C illustrates the breakage of single-use locking socket 258 and separation of reusable shaft portion 250.

It is appreciated that the switch shown in the illustrated embodiments of FIGS. 3A-3B can also be employed in the embodiment of FIGS. 5A-5C.

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

The invention claimed is:

1. A tamper-resistant remotely monitorable electronic seal comprising:

a shaft portion, comprising an inductor;

a sensor;

a socket, comprising a transponder, said socket being arranged to engage said shaft portion and said sensor in a monitorable manner; and a wireless communicator associated with at least one of said shaft portion, said sensor and said socket and being operative to provide a remotely monitorable indication of at least one monitorable event, said sensor being operative to sense application of force to said electronic seal in an attempt to separate said shaft portion from said socket and to indicate said application of force as one of said at least one monitorable event, and said transponder being operative to transmit information relating to said socket, via said inductor, to said wireless communicator.

2. A tamper-resistant remotely monitorable electronic seal according to claim 1 and wherein said sensor is also operative to sense disengagement of said shaft portion and said sensor and to indicate said disengagement as one of said at least one monitorable event.

3. A tamper-resistant remotely monitorable electronic seal according to claim 1 and also comprising a sensing cap mounted on said shaft portion and supporting said sensor.

4. A tamper-resistant remotely monitorable electronic seal according to claim 1 and wherein said sensor comprises a temperature sensor which is operative to monitor heating of said socket and to indicate heating thereof beyond a predetermined threshold as one of said at least one monitorable event.

5. A tamper-resistant remotely monitorable electronic seal according to claim 3 and also comprising at least one retaining ring engaging said socket and said shaft portion for retaining said sensing cap in said socket independently of said shaft portion and wherein said shaft portion includes a frangible portion, whereby application of a force to separate said shaft portion from said socket causes breakage between said sensing cap and said shaft portion at said frangible portion, which breakage is one of said at least one monitorable event.

6. A tamper-resistant remotely monitorable electronic seal according to claim 1 and wherein said socket comprises a single-use socket.

7. A tamper-resistant remotely monitorable electronic seal according to claim 1 and wherein said socket is a mechanically lockable socket.

8. A tamper-resistant remotely monitorable electronic seal according to claim 1 and wherein said transponder comprises an RF transponder and said inductor comprises an RF receive/transmit inductor and wherein said inductor communicates via at least one conductor extending through said shaft portion to said wireless communicator.

9. A tamper-resistant remotely monitorable electronic seal according to claim 1 and wherein said shaft portion includes at least one conductor which is interrupted in response to disengagement of said shaft portion and said sensor and wherein said disengagement results in one of said at least one monitorable event.

10. A tamper-resistant remotely monitorable electronic seal according to claim 9 and wherein there is associated with said at least one conductor at least one propinquity switch which is operated by an actuator associated with said socket whereby when said shaft portion is separated from said socket said switch is opened and at least one conductive path is broken, producing one of said at least one monitorable event.

11. A tamper-resistant remotely monitorable electronic seal according to claim 10 and wherein said at least one propinquity switch comprises at least one magnetic switch and said actuator comprises a magnet.

12. A tamper-resistant remotely monitorable electronic seal according to claim 1 and wherein said communicator is located in a sensing circuitry and communicator housing integrally formed with said shaft portion.

13. A tamper-resistant remotely monitorable electronic seal according to claim 1 and wherein:

said shaft portion comprises a frangible shaft portion having a lockable portion; and said socket comprises a locking element arranged to engage said lockable portion in a removable manner, whereby disengagement of said locking element and said shaft portion results in one of said at least one monitorable event.

14. A tamper-resistant remotely monitorable electronic seal according to claim 13 and wherein said sensor comprises a temperature sensor which is operative to monitor heating of said socket and to indicate heating thereof beyond a predetermined threshold as one of said at least one monitorable event.

15. A tamper-resistant remotely monitorable electronic seal according to claim 13 and wherein said transponder comprises an RF transponder and said inductor comprises an RF receive/transmit inductor and wherein said inductor communicates via at least one conductor extending through said shaft portion to said wireless communicator.

16. A tamper-resistant remotely monitorable electronic seal comprising:

a shaft portion including at least one conductor;

a sensor;

a socket, arranged to engage said shaft portion and said sensor in a monitorable manner;

a wireless communicator associated with at least one of said shaft portion, said sensor and said socket and being operative to provide a remotely monitorable indication of at least one monitorable event;

at least one propinquity switch, which is associated with said at least one conductor and which is operated by an actuator associated with said socket, said sensor being operative to sense application of force to said electronic seal in an attempt to separate said shaft portion from said socket and to indicate said application of force as one of said at least one monitorable event, said at least one conductor being interrupted in response to disengagement of said shaft portion and said sensor, wherein said disengagement results in one of said at least one monitorable event, and said propinquity switch being opened in response to said shaft portion being separated from said socket, thereby braking at least one conductive path and producing one of said at least one monitorable event.

17. A tamper-resistant remotely monitorable electronic seal according to claim 16 and wherein said sensor is also operative to sense disengagement of said shaft portion and said sensor and to indicate said disengagement as one of said at least one monitorable event.

18. A tamper-resistant remotely monitorable electronic seal according to claim 16 and also comprising a sensing cap mounted on said shaft portion and supporting said sensor.

19. A tamper-resistant remotely monitorable electronic seal according to claim 18 and also comprising at least one retaining ring engaging said socket and said shaft portion for retaining said sensing cap in said socket independently of said shaft portion and wherein said shaft portion includes a frangible portion, whereby application of a force to separate said shaft portion from said socket causes breakage between said sensing cap and said shaft portion at said frangible portion, which breakage is one of said at least one monitorable event.

20. A tamper-resistant remotely monitorable electronic seal according to claim 16 and wherein said sensor comprises a temperature sensor which is operative to monitor heating of said socket and to indicate heating thereof beyond a predetermined threshold as one of said at least one monitorable event.

21. A tamper-resistant remotely monitorable electronic seal according to claim 16 and wherein said socket comprises a single-use socket.

22. A tamper-resistant remotely monitorable electronic seal according to claim 16 and wherein said socket is a mechanically lockable socket.

23. A tamper-resistant remotely monitorable electronic seal according to claim 16 and wherein said communicator is located in a sensing circuitry and communicator housing integrally formed with said shaft portion.

24. A tamper-resistant remotely monitorable electronic seal according to claim 16 and wherein said at least one propinquity switch comprises at least one magnetic switch and said actuator comprises a magnet.

25. A tamper-resistant remotely monitorable electronic seal according to claim 16 and wherein:

said shaft portion comprises a frangible shaft portion having a lockable portion; and said socket comprises a locking element arranged to engage said lockable portion in a removable manner, whereby disengagement of said locking element and said shaft portion results in one of said at least one monitorable event.

26. A tamper-resistant remotely monitorable electronic seal according to claim 25 and wherein said sensor comprises a temperature sensor which is operative to monitor heating of said socket and to indicate heating thereof beyond a predetermined threshold as one of said at least one monitorable event.

* * * * *